US010427761B2

(12) United States Patent
Grovender

(10) Patent No.: US 10,427,761 B2
(45) Date of Patent: Oct. 1, 2019

(54) RETRACTABLE MARINE BOARDING LADDER

(71) Applicant: Premier Marine, Inc., Wyoming, MN (US)

(72) Inventor: David L. Grovender, North Branch, MN (US)

(73) Assignee: Premier Marine, Inc., Wyoming, MN (US)

( * ) Notice: Subject to any disclaimer, the term of this patent is extended or adjusted under 35 U.S.C. 154(b) by 0 days.

(21) Appl. No.: 14/252,004

(22) Filed: Apr. 14, 2014

(65) Prior Publication Data

US 2015/0291262 A1 Oct. 15, 2015

(51) Int. Cl.
*B63B 27/14* (2006.01)

(52) U.S. Cl.
CPC ..... *B63B 27/146* (2013.01)

(58) Field of Classification Search
CPC . E06C 1/3835; E06C 1/32; E06C 1/18; E06C 1/387; E06C 1/383; E06C 1/54; E06C 1/38; E06C 1/393; B63B 27/146
See application file for complete search history.

(56) References Cited

U.S. PATENT DOCUMENTS 2,512,150 A * 6/1950 Geren ..... 92/18
3,774,720 A 11/1973 Hovey
3,794,140 A 2/1974 Sell
4,153,138 A * 5/1979 Walberg ..... 182/98
4,168,764 A * 9/1979 Walters ..... 182/1
4,180,142 A * 12/1979 Sevillano et al. ..... 182/77
4,541,508 A * 9/1985 Lundh ..... 182/78
4,899,420 A * 2/1990 Bye et al. ..... 16/16
4,926,965 A 5/1990 Fox
4,971,168 A * 11/1990 Stanescu ..... 182/1
(Continued)

FOREIGN PATENT DOCUMENTS

CN 101218412 A 7/2008
CN 202879747 U 4/2013
(Continued)

OTHER PUBLICATIONS

English_Machine_translation_of_JPH04372491.pdf (Year: 1992).*
(Continued)

*Primary Examiner* — Katherine W Mitchell
*Assistant Examiner* — Shiref M Mekhaeil
(74) *Attorney, Agent, or Firm* — Shumaker & Sieffert, P.A.

(57) ABSTRACT

The present system is directed in various embodiments to marine ladders comprising movement assistance for the transition from a deployed position to a stowed position and to assist in controlling the transition from the stowed position to the deployed position. In certain embodiments, the gas springs and associated pivot point brackets hold the deployed ladder biased in the deployed position with a biasing force that may be overcome by application of force by the user to initiate an automatic stowing process. The initial force to initiate the stowing process is provided by the force of water flowing against an aft-mounted ladder as a result of the boat moving forward. In the case of movement assistance from the stowed to deployed position, the user applies force to initiate the transition while the gas springs apply an opposing force that slows the transition for safety.

17 Claims, 6 Drawing Sheets

(56) References Cited

U.S. PATENT DOCUMENTS

| | | | | |
|---|---|---|---|---|
| 5,033,134 | A * | 7/1991 | Burchett | 5/133 |
| 5,427,049 | A | 6/1995 | Markikian | |
| 6,047,659 | A * | 4/2000 | Schmidt, Jr. | 114/369 |
| 6,212,827 | B1 * | 4/2001 | Miller | 49/345 |
| 6,347,686 | B1 * | 2/2002 | Hedley et al. | 182/86 |
| 6,354,382 | B1 * | 3/2002 | Jarman et al. | 172/213 |
| 6,598,562 | B1 * | 7/2003 | Dutkiewicz et al. | 119/706 |
| 6,662,901 | B1 * | 12/2003 | Appl | 182/77 |
| 6,904,863 | B2 | 6/2005 | Markidian et al. | |
| 6,991,063 | B2 * | 1/2006 | Latimer et al. | 182/78 |
| 7,621,374 | B2 * | 11/2009 | Richey | 182/77 |
| 7,707,955 | B1 * | 5/2010 | Johns et al. | 114/259 |
| 8,479,677 | B2 * | 7/2013 | Bolline et al. | 114/362 |
| 8,997,411 | B2 * | 4/2015 | Whitten et al. | 52/183 |
| 9,238,941 | B2 | 1/2016 | Ellement | |
| 2005/0016439 | A1 | 1/2005 | Mardikian et al. | |
| 2005/0028320 | A1 * | 2/2005 | Latimer et al. | 16/231 |
| 2005/0029042 | A1 * | 2/2005 | Latimer et al. | 182/77 |
| 2006/0011416 | A1 * | 1/2006 | Gonzalez y Gil et al. | 182/127 |
| 2006/0272895 | A1 * | 12/2006 | Lavoie | 182/127 |
| 2007/0095610 | A1 * | 5/2007 | Grundler | 182/93 |
| 2008/0078615 | A1 * | 4/2008 | Fowlds | 182/163 |
| 2008/0179137 | A1 * | 7/2008 | Latimer et al. | 182/77 |
| 2008/0231076 | A1 * | 9/2008 | Plavetich | B60R 3/02 296/183.1 |
| 2009/0038885 | A1 * | 2/2009 | Ellement | 182/97 |
| 2009/0288351 | A1 * | 11/2009 | Burke | 52/183 |
| 2010/0089695 | A1 * | 4/2010 | McIntire et al. | 182/77 |
| 2010/0116590 | A1 * | 5/2010 | Rund | 182/127 |
| 2010/0192487 | A1 * | 8/2010 | Thornton et al. | 52/183 |
| 2011/0017122 | A1 * | 1/2011 | Muller | 114/362 |
| 2012/0012423 | A1 * | 1/2012 | Murphy | 182/96 |
| 2012/0145480 | A1 * | 6/2012 | Willis et al. | 182/106 |
| 2012/0181109 | A1 * | 7/2012 | Rund | 182/97 |
| 2012/0199417 | A1 * | 8/2012 | Richey et al. | 182/129 |
| 2013/0247812 | A1 * | 9/2013 | Perkins | 114/362 |
| 2014/0224585 | A1 * | 8/2014 | Russell et al. | 182/116 |
| 2014/0318892 | A1 * | 10/2014 | Meyen et al. | 182/127 |

FOREIGN PATENT DOCUMENTS

| | | |
|---|---|---|
| JP | 04372491 A * | 12/1992 |
| JP | H04372491 A | 12/1992 |
| JP | 3153564 | 4/2001 |

OTHER PUBLICATIONS

"Dive Ladders" Diving Equipment specialties (online). Jun. 1, 2003, Retrieved on Jun. 23, 2015. Retrieved from the Internet <https://web.archive.org/web/20030601092530/http:/www.techdivetools.com/boat/ladders.html>, figure 1, p. 3; page 2, second paragraph.

Office Action of corresponding Chinese Application No. 201580030167.5 dated Nov. 24, 2017.

Second Office Action and Search Report, and translation thereof, from counterpart Chinese Application No. 201580030167.5, dated Jul. 20, 2018, 19 pp.

Third Office Action, and translation thereof, from counterpart Chinese Application No. 201580030167.5, dated Feb. 15, 2019, 12 pp.

* cited by examiner

RETRACTABLE MARINE BOARDING LADDER

CROSS-REFERENCE TO RELATED APPLICATIONS

None

FIELD OF THE INVENTION

The present invention generally relates to systems for marine boat ladders generally. More specifically, the present invention relates to systems enabling retractable marine boarding ladders.

DESCRIPTION OF THE RELATED ART

Generally, various embodiments of the present invention comprise an improved marine boarding ladder. As the skilled artisan will recognize, marine boarding ladders, e.g., swim ladders, and the like, are well known.

However, the known marine ladders do not incorporate mechanisms to hold the ladder in the deployed position nor do they reduce the force required to raise the ladder into a stowed position or automatically retract the ladder into the stowed position.

For example, some known ladders rotate at a point near the top of the ladder to stow or deploy. This requires application of force by the user throughout the process and may be quite awkward and difficult for some users. Some ladders also comprise a telescoping lower section that must be manually extended in order to achieve the deployed position and manually retracted. Still other ladders are permanently affixed to the boat. One feature all known non-permanent ladders have in common is that they all require a user to apply force throughout the processes of stowing and deployment sufficient to move the ladder into a stowed or deployed position.

Thus, a need exists in the art generally for a marine ladder that provides movement assistance for the transition from a deployed position to a stowed position. A further need exists in the art for a deployed marine ladder that, following an initial application of force, automatically stows without further user intervention.

The present invention addresses these, among other, needs.

BRIEF SUMMARY OF THE INVENTION

The present system is directed in various embodiments to marine ladders comprising movement assistance for the transition from a deployed position to a stowed position and from the stowed position to the deployed position. In certain embodiments, the gas springs and associated pivot point brackets hold the deployed ladder biased in the deployed position with a biasing force that may be overcome by application of force by the user to initiate an automatic stowing process. Alternatively, and most preferably, the initial force to initiate the automatic stowing process is provided by the force of water flowing against an aft-mounted ladder as a result of the boat moving forward. The remainder of the force required to complete the automatic stowing process is provided by the gas springs. In the case of movement assistance from the stowed to deployed position, the user applies force to initiate the transition while the gas springs apply an opposing force that slows the transition for safety.

DETAILED DESCRIPTION

Figure 1:
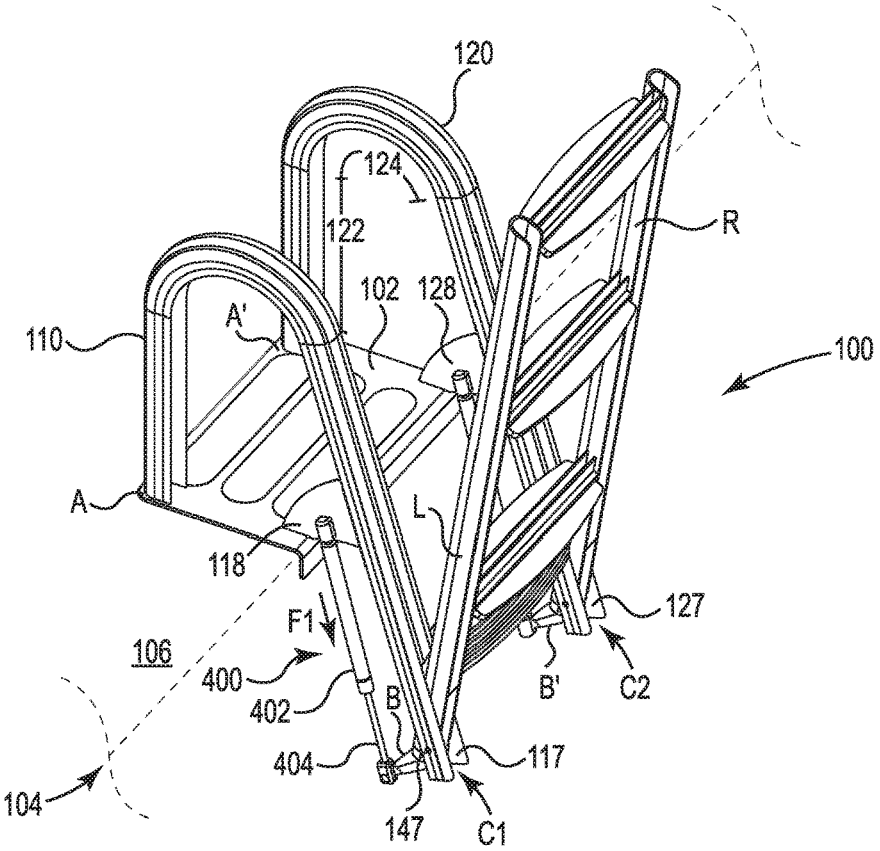
FIG. 1 illustrates perspective view of one embodiment of the present invention in a stowed position.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

The present invention provides a marine ladder 100 that is connected to a boat 104 for boarding and disembarking and comprising a fixed section 200 and a rotatable section 300. As illustrated in the Figures, the ladder 100 is preferably fixedly mounted to the aft portion of a deck 106 of boat 104, however, alternate locations for the ladder 100 mounting are within the scope of the present invention. Mounting bracket 102, having a right side, a left side, a front side and a rear side is mounted to the deck 106 by a variety of means, including bolting, screwing and the like, all of which will be well known to the skilled artisan.

Fixed section 200 of ladder 100 comprises first and second handrails 110 and 120. First handrail 110 is shown with a first fixed proximal section 112 that is mounted or otherwise affixed to the left side of mounting bracket 102 at point A, proximate the rear side of mounting bracket 102, a first fixed curvilinear section 114 connected to the first fixed proximal section 112 and a first fixed extension section 116 connected to the first fixed curvilinear section 114.

The second handrail 120 is illustrated with a second fixed proximal section 122 mounted or otherwise affixed to the right side of mounting bracket 102 at point A', proximate the rear side of mounting bracket 102, a second fixed curvilinear section 124 connected to the second fixed proximal section 122 and a second fixed extension section 126 connected to the second fixed curvilinear section 124.

Fixed section 200 further comprises first and second brackets 118 and 128 for fixedly attaching first and second fixed extension sections 116 and 126, respectively, to the front side of mounting bracket 102. Certain embodiments of fixed section 200 may comprise, as illustrated, one or more step elements 150 fixedly connected between the first and second handrails 110 and 120. Fixed extension sections 116 and 126 comprise distal ends 117 and 127, respectively, where channels C1 and C2 are defined.

Rotating section 300 of ladder 100 is a rigid structure that rotates as a single plane relative to fixed section 200. As illustrated in the Figures, rotating section 300 comprises a left handrail L configured for aligning with first handrail 110 of fixed section 200; a right handrail R configured for aligning with second handrail 120 of fixed section 200; and one or more step elements 150 disposed between the left and right handrails L and R. Each left and right handrail L and R comprises a proximal end P, P', that are rotatingly affixed within a corresponding channel C1, C2 in the first and second handrails 110, 120. As illustrated, the first proximal end P of the left handrail L is rotatingly affixed within the first channel C1 by a first fastener 147; and the second proximal end P' of the right handrail R is rotatingly affixed within the second channel C2 by a second fastener 147'. In a non-limiting exemplary embodiment, first and second fasteners 147 and 147' may be a nut and bolt system or equivalent as the skilled artisan will readily recognize, each such equivalent fastener being within the scope of the present invention.

Rotating section 300 further comprises first and second pivot point brackets B and B' fixedly attached to corresponding tops T and T' of respective first and second proximal ends P and P' of left and right handrails L and R. As can be seen in the Figures, when rotating section 300 transitions to the deployed position, the first and second pivot point brackets B and B' engage first and second channels C1 and C2, respectively. Each first and second pivot point bracket B and B' is attached to the corresponding top T and T' with an angle $\alpha$ therebetween. Angle $\alpha$ is illustrated as obtuse and approximately 135 degrees, though other angle degrees may be functionally equivalent and are also within the scope of the present invention.

Figure 2:
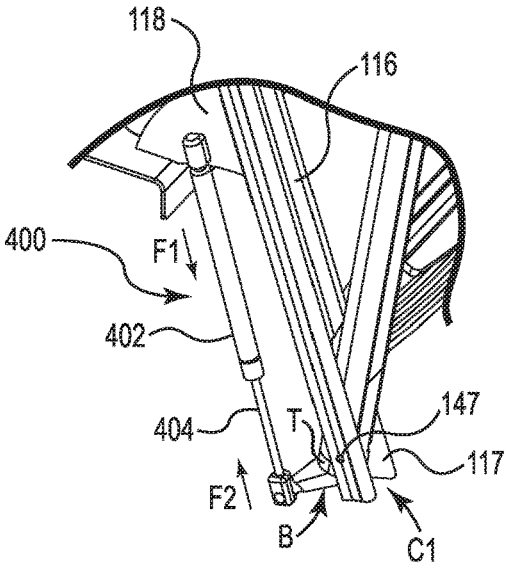
FIG. 2 illustrates a cutaway perspective view of one embodiment of the present invention in the stowed position.

Ladder 100 includes first and second gas springs 400 and 400' comprising respective first and second gas-filled cylinders 402 and 402' and first and second rods 404 and 404'. First and second rods 404 and 404' are extendible (or translatable) into and out of corresponding first and second gas-filled cylinders 402 and 402' depending on the magnitude of the opposing forces that first and second rods 404 and 404' are subjected to. As shown in FIG. 2, first force F1 produced by the gas within first and second gas springs 400 and 400' tends to push the respective first and second rods 404 and 404' outwardly from corresponding first and second gas-filled cylinders 402 and 402', while second force F2 applied to first and second rods 404 and 404' by corresponding first and second pivot point brackets B and B' tends to push, i.e., translate, the first and second rods 404 and 404' back into respective first and second gas-filled cylinders 402 and 402'. First or second force F1 or F2 having a larger magnitude will generally dictate the translated position of the first and second rods 404 and 404' relative to the corresponding first and second gas-filled cylinders 402 and 402' as well as relative to the first and second pivot point brackets B and B'.

First gas spring 400 is illustrated connecting the first bracket 118 and the first pivot point bracket B; and second gas spring 400' is illustrated connecting the second bracket 128 and the second pivot point bracket B'. In the illustrated embodiment, the first gas-filled cylinder 402 is fixedly connected to the first bracket 118, and the first rod 404 is rotatably connected to the first pivot point bracket B. Similarly, the second gas-filled cylinder 402' is fixedly connected to the second bracket 128, and the second rod 404' is rotatably connected to the second pivot point bracket B'. The rotatable connections of first and second rods 404 and 404' to corresponding first and second pivot point brackets B and B' can be made in a variety of ways known to the skilled artisan, e.g., each first and second rod 404 and 404' may comprise an eyelet configured for rotatable securement to corresponding first and second pivot point brackets B and B' by a bolt or the equivalent.

Figure 3:
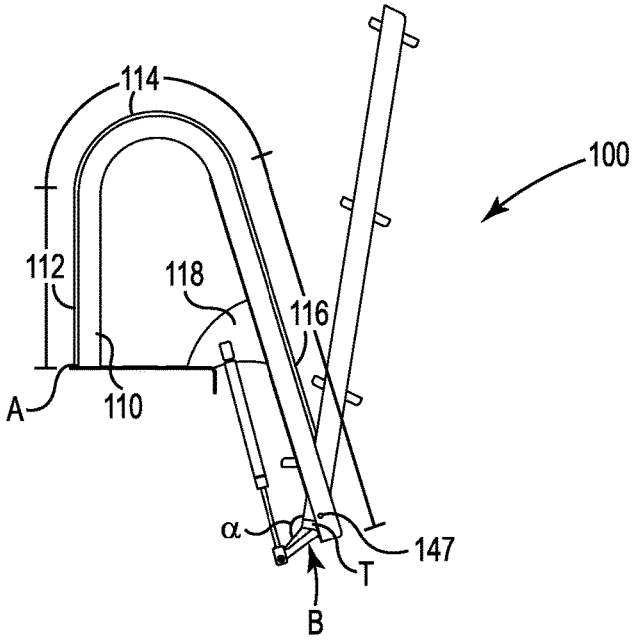
FIG. 3 illustrates a side view of one embodiment of the present invention in the stowed position.

Having described the structure of the present invention, we now turn to the operation of the subject ladder 100. FIGS. 1-3 illustrate the ladder 100 in the stowed position. In this stowed position, the rotating section 300 is held in place by the first force F1 being greater than the second force F2.

Figure 4:
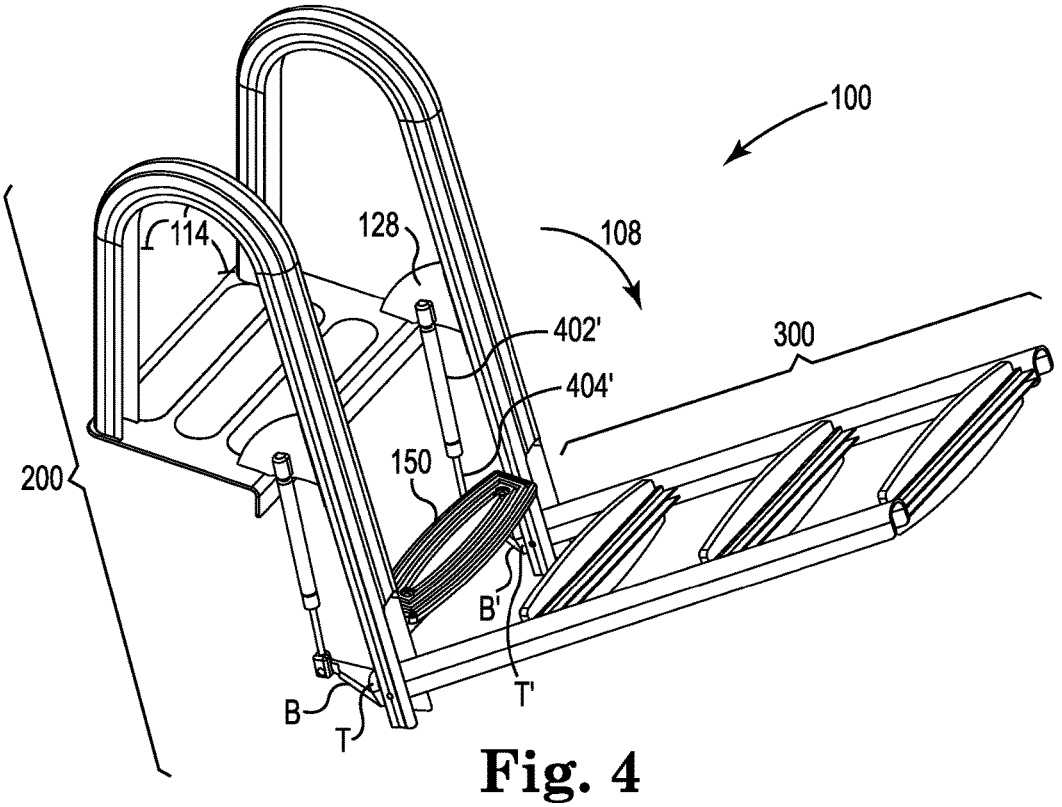
FIG. 4 illustrates a perspective view of one embodiment of the present invention at a point in the transition from the stowed position to a deployed position.

FIG. 4 illustrates the rotating section 300 transitioning in the direction indicated by the arrow 108 from the stowed position of FIGS. 1-3 toward a deployed position as will be described further with reference to FIGS. 6 and 7. To reach this transitional position, a user may have supplied sufficient force to the rotating section 300 to overcome first force F1, so that second force F2 overcomes first force F1 and allows the first and second rods 404 and 404' to translate into corresponding first and second gas-filled cylinders 402 and 402' with the result that rotating section 300 begins rotating downward around first and second fasteners 147 and 147' and relative to fixed section 200. The first force F1 provides a continued oppositional force to the downwardly transitioning rotating section 300, wherein the first and second rods 404 and 404' are biased to extend out from first and second gas-filled cylinders 402 and 402' by the first force F1 of the pressurized gas within first and second gas springs 400 and 400'. This oppositional force allows the rotating section 300 a smooth and controlled downward rotation toward the deployed position.

Figure 5:
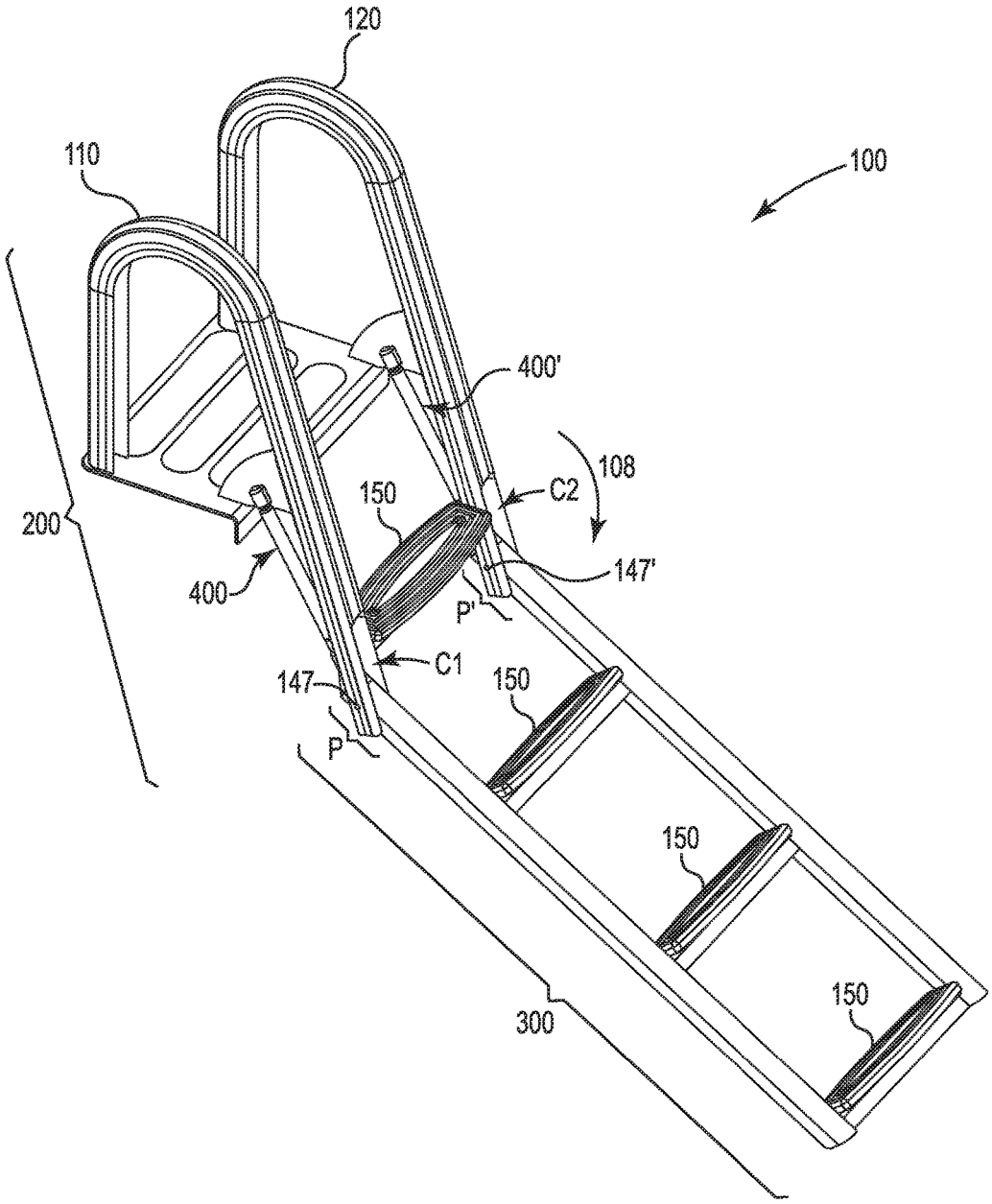
FIG. 5 illustrates a perspective view of one embodiment of the present invention at a point in the transition from the stowed position to the deployed position.

At a point in the transitional downward process, the mass of the rotating section 300 provides a force sufficient to overcome first force F1, without aid of the user's added downward force on rotating section 300 as seen in FIGS. 4 and 5. To be clear, the user's added downward force is initially required to initiate the transition from the stowed to the deployed position, but only until the mass of the rotating section 300 is positioned to provide sufficient force to overcome first force F1. Once this point is reached, the rotating section 300 will continue to rotate towards the deployed position without application of any force by the user. As described above, the first force F1 from the first and second gas springs 400 and 400' continues to provide oppositional force to the rotating section 300 to allow a smooth and controlled rotation to the deployed position. In practice, if any portion of the rotating section 300 submerges into the water, the rotating section 300 may require a small amount of user-applied force to fully deploy the ladder 100.

Figure 6:
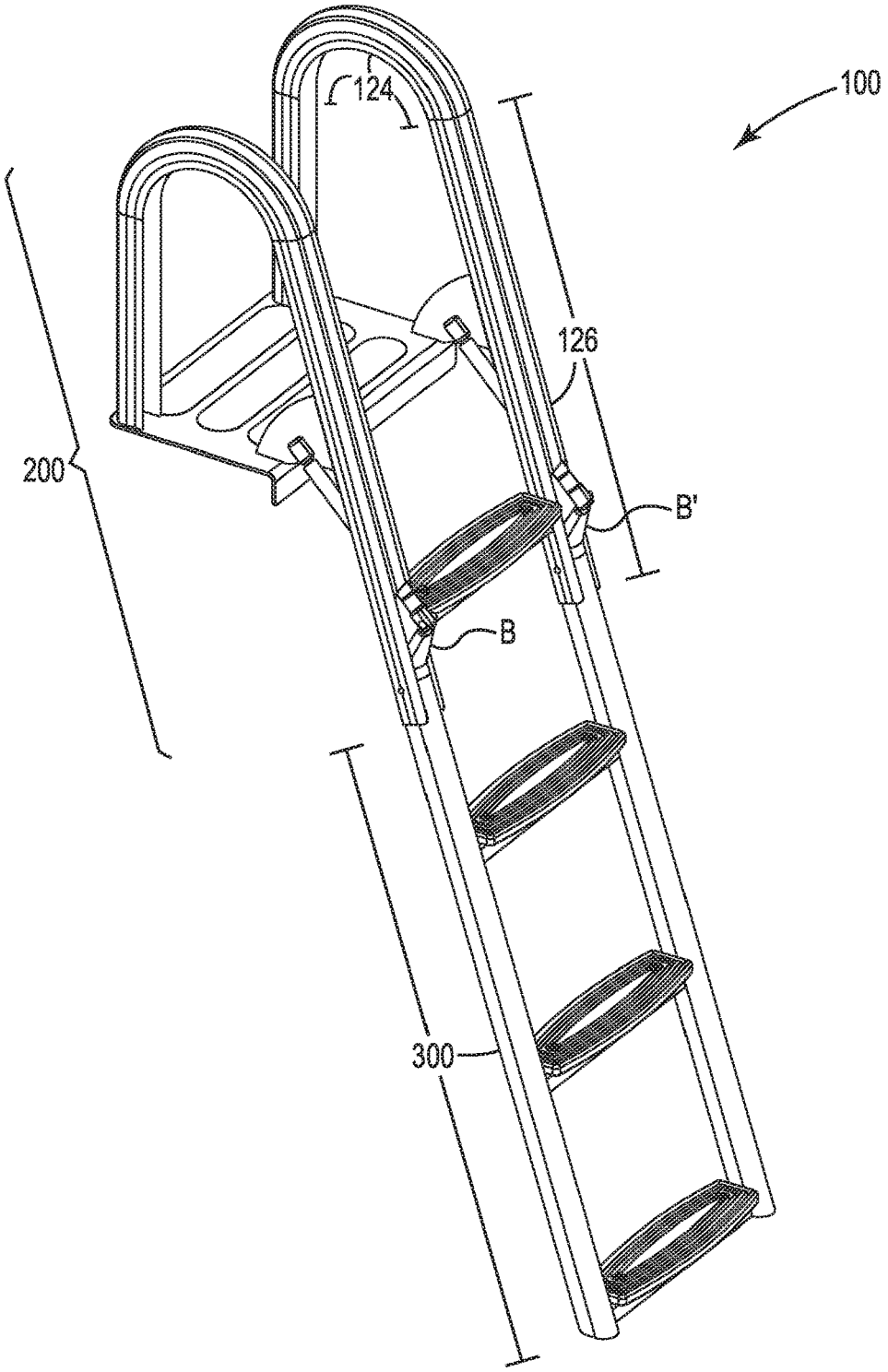
FIG. 6 illustrates a perspective view of one embodiment of the present invention in the deployed position.

The continued freely downward transition of rotation section 300, i.e., without need of any additional downward force provided by, e.g., a user, results in the deployed position which is illustrated in FIG. 6. There, the left and right handrails L and R of rotating section 300 substantially align with the first and second fixed extension sections 116 and 126 of fixed section 200, placing the step elements 150 in the fixed section 200 and in the rotating section 300 in substantial alignment, thereby enabling the user to ascend or descend the step elements 150 at a constant pitch as in, e.g., a staircase.

Once the deployed position such as illustrated in FIG. 6 is achieved, the first and second rods 404 and 404' are fully engaged within the corresponding first and second gas-filled cylinders 402 and 402' of respective first and second gas springs 400 and 400'. The first and second gas springs 400 and 400', the first and second fixed extension sections 116 and 126, and the first and second pivot point brackets B and B' may function to hold the ladder 100 in the deployed position until external force is applied for stowing the ladder 100. First and second pivot point brackets B and B' may extend outwardly through first and second channels C1 and C2 when the ladder 100 is fully deployed.

Figure 7:
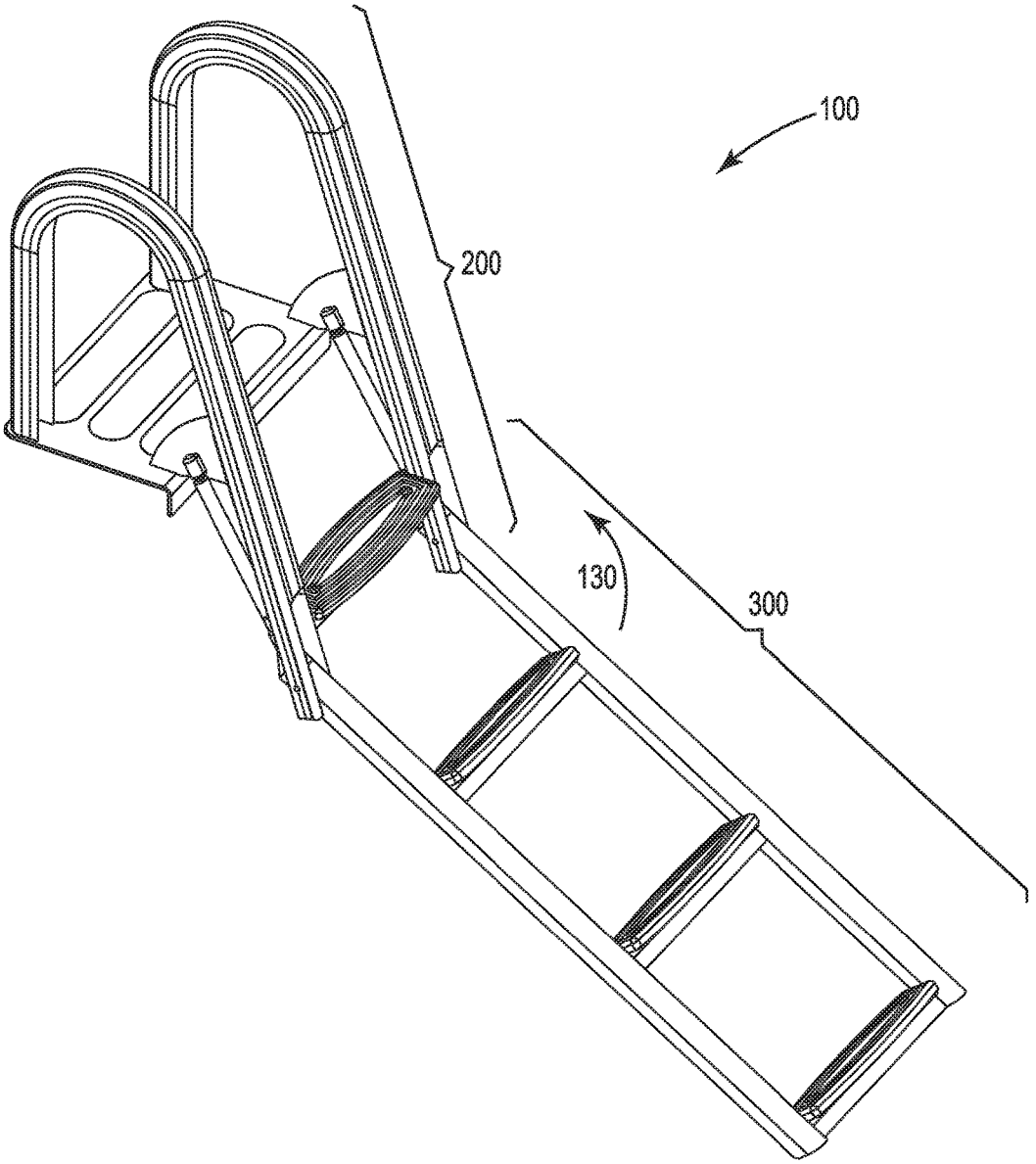
FIG. 7 illustrates a perspective view of one embodiment of the present invention at a point in the transition from the deployed position of FIG. 6 to the stowed position of FIG. 1.
Figure 8:
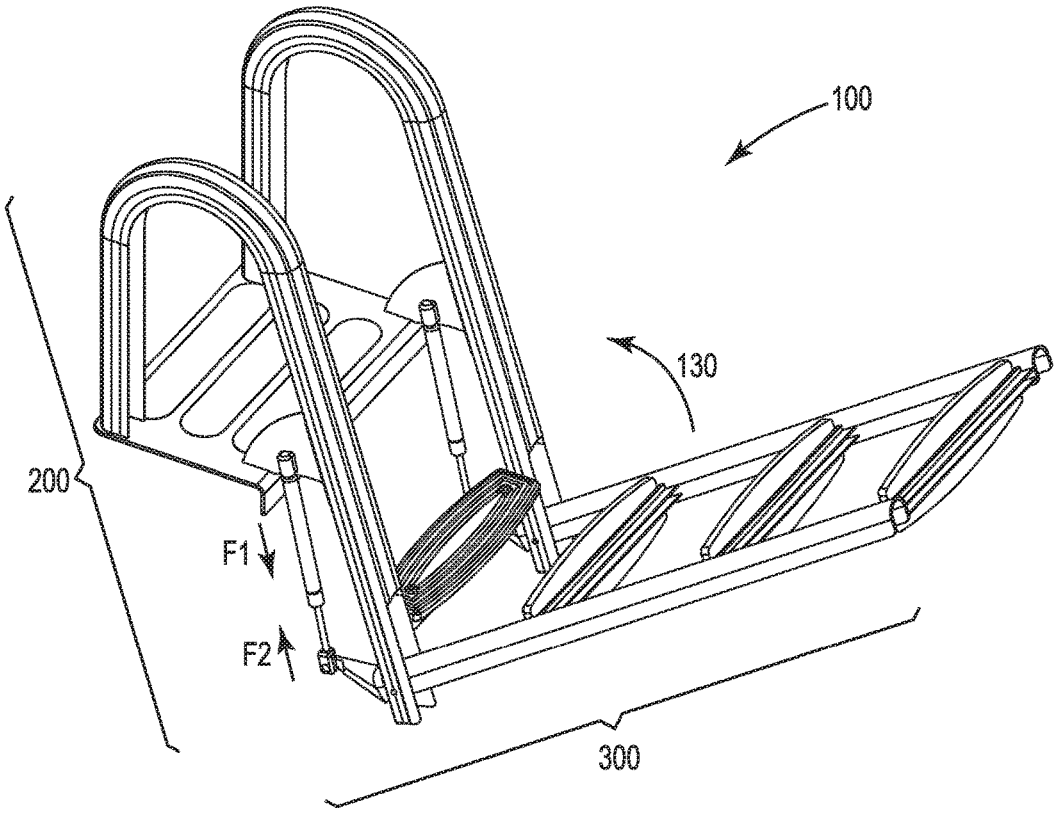
FIG. 8 illustrates a perspective view of one embodiment of the present invention at a point in the transition from the deployed position to the stowed position of FIG. 1.

FIGS. 7 and 8 illustrate the rotating section 300 transitioning in the direction indicated by the arrow 130 from the deployed position illustrated in FIG. 6 to the stowed position illustrated in FIG. 1. An initial upwardly, or horizontally, applied force is required to move the rotating section 300 out of the deployed position towards the stowed position. This force can be provided by a user. Alternatively or in addition thereto, if the ladder 100 is mounted on the aft section of the boat 104, then the force can be applied to the submerged portion of the ladder 100 by the water when the boat 104 moves in the forward direction.

At a point in the upward transition from the deployed position to the stowed position, the first force F1 will overcome the downward forces on the rotating section 300, e.g., downward force due to the mass of the rotating section 300. At this point, the first force F1 from the first and second gas springs 400 and 400' work to extend the first and second rods 404 and 404' out from the first and second gas-filled gas cylinders 402 and 402' to enable smooth upward rotation of the rotating section 300 in the direction 130 as illustrated in FIG. 8. This upward rotation to the stowed position continues, without requiring further external force, e.g., from the user, until the rotating section 300 reaches the fully stowed position illustrated in FIG. 1. When fully stowed, the first force F1 from the pressurized gas in the first and second gas springs 400 and 400' keep the ladder 100 in the stowed position until external force is applied for deploying the ladder 100.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A marine boarding ladder for a boat, the ladder comprising:

a fixed section configured for being attached to the boat comprising at least one mounting bracket for being attached to the boat;

a rotating section rotatable relative to the fixed section between a stowed position and a deployed position, the rotating section comprising:

a first handrail rotatingly affixed to the fixed section;

a second handrail rotatingly affixed to the fixed section; and one or more step elements disposed between the first and second handrails; and at least one gas spring operably connected between the fixed section and the rotating section, the at least one gas spring comprising a first gas spring, each of the at least one gas spring comprising:

a gas-filled cylinder; and a rod extendible into and out of the gas-filled cylinder;

wherein the fixed section further comprises:

a third handrail comprising:

a first fixed proximal section affixed to the at least one mounting bracket;

a first fixed curvilinear section connected to the first fixed proximal section; and a first fixed extension section connected to the first fixed curvilinear section;

a first bracket fixedly attached to the first fixed extension section; and a fourth handrail comprising:

a second fixed proximal section affixed to the at least one mounting bracket;

a second fixed curvilinear section connected to the second fixed proximal section;

and a second fixed extension section connected to the second fixed curvilinear section, wherein the rotating section comprises a first pivot point bracket located at a proximal end of the first handrail and the first gas spring is operably connected between the first bracket and the first pivot point bracket, and wherein the fixed section, the rotating section, and the at least one gas spring are configured such that:

gas within the gas-filled cylinder is configured to apply a first force to the rod to push the rod outwardly from the gas-filled cylinder to maintain the rotating section in the deployed position when the rotating section is in the deployed position and at least a portion of the rotating section is submerged in a body of water;

a force applied by the water against the portion of the rotating section as a result of the ladder moving relative to the body of water causes the rotating section to apply a second force that is greater than and opposed to the first force upon the rod to push the rod into the gas-filled cylinder to rotate the rotating section from the deployed position toward the stowed position;

the second force applied by the rotating section is reduced as a result of the force applied by the water against the portion of the rotating section, reducing said second force as the rotating section rotates from the deployed position toward the stowed position, wherein the second force is reduced until the second force is less than the first force and the gas within the gas-filled cylinder pushing the rod outwardly from the gas-filled cylinder to rotate the rotating section into the stowed position; and the at least one gas spring defines a longitudinal axis that is angled toward the body of water such that the gas opposes movement of the rotating section from the stowed position into the deployed position.

2. The ladder of claim 1, comprising one or more step elements fixedly connected between the first and second fixed extension sections.

3. The ladder of claim 1, further comprising:

a first fastener rotatingly affixing a proximal end of the first handrail with a distal end of the first fixed extension section; and a second fastener rotatingly affixing a proximal end of the second handrail with a distal end of the second fixed extension section.

4. The ladder of claim 1, wherein the first pivot point bracket is fixedly attached to the proximal end of the first handrail at an obtuse angle therebetween.

5. The ladder of claim 1, wherein the first handrail is configured for aligning with the first fixed extension section and the second handrail is configured for aligning with the second fixed extension section, when the rotating section is in the deployed position.

6. The ladder of claim 1, wherein the at least one gas spring is further configured to maintain the rotating section in the stowed position until a third force is acted upon the rotating section moving it from the stowed position toward the deployed position.

7. The ladder of claim 1, wherein the fixed section is fixedly attached to an aft section of the boat.

8. The ladder of claim 1, wherein the at least one gas spring further comprises a second gas spring operably connected between the fixed section and the rotating section.

9. The ladder of claim 8, wherein the fixed section comprises a second bracket and the rotating section comprises a second pivot point bracket located at a proximal end of the second handrail and the second gas spring is operably connected between the second bracket and the second pivot point bracket.

10. The ladder of claim 9, wherein: the second gas spring comprises: a second gas-filled cylinder; and a second rod extendible into and out of the second gas-filled cylinder.

11. The ladder of claim 10, wherein:

the first gas-filled cylinder is connected to the first bracket;

the first rod is rotatably connected to the first pivot point bracket;

the second gas-filled cylinder is connected to the second bracket; and the second rod is rotatably connected to the second pivot point bracket.

12. The ladder of claim 11, wherein the first force exerted by pressurized gas within the first and second gas-filled cylinders pushes the corresponding first and second rods outwardly from their respective first and second gas-filled cylinders.

13. The ladder of claim 12, wherein the second force is exerted through the first and second pivot point brackets to push the corresponding first and second rods into their respective first and second gas-filled cylinders.

14. The ladder of claim 1, wherein the at least one gas spring further comprises a second gas spring wherein the fixed section further comprises a second bracket fixedly attached to the second fixed extension section and the rotating section comprises a second pivot point bracket located at a proximal end of the second handrail and the second gas spring is operably connected between the second bracket and the second pivot point bracket.

15. The ladder of claim 1, wherein the at least one gas spring further comprises a second gas spring operably connected between the fixed section and the rotating section and wherein the fixed section comprises a second bracket and the rotating section comprises a second pivot point bracket located at a proximal end of the second handrail and the second gas spring is operably connected between the second bracket and the second pivot point bracket.

16. The ladder of claim 1, wherein the first and second handrail are shaped to define a respective first and second longitudinal channel that extend into the first and second handrail along a length of a respective first and second surface of the first and second handrail that faces the boat when the rotating section is in the deployed position.

17. A marine boarding ladder for a boat, the ladder comprising:

a fixed section configured for being attached to an aft section of the boat comprising at least one mounting bracket for being attached to the boat;

a rotating section rotatable relative to the fixed section between a stowed position and a deployed position, the rotating section comprising:

a first handrail rotatingly affixed to the fixed section;

a second handrail rotatingly affixed to the fixed section;

one or more step elements disposed between the first and second handrails; and at least one gas spring operably connected between the fixed section and the rotating section, the at least one gas spring comprising a first gas spring;

wherein the fixed section further comprises:

a third handrail comprising:

a first fixed proximal section affixed to the at least one mounting bracket;

a first fixed curvilinear section connected to the first fixed proximal section; and a first fixed extension section connected to the first fixed curvilinear section;

a first bracket fixedly attached to the first fixed extension section; and a fourth handrail comprising:

a second fixed proximal section affixed to the at least one mounting bracket;

a second fixed curvilinear section connected to the second fixed proximal section;

and a second fixed extension section connected to the second fixed curvilinear section, wherein the rotating section comprises a first pivot point bracket located at a proximal end of the first handrail and the first gas spring is operably connected between the first bracket and the first pivot point bracket, and wherein the fixed section, the rotating section, and the at least one gas spring are configured such that:

a spring force of the at least one gas spring is configured to maintain the rotating section in the deployed position when the rotating section is in the deployed position and at least a portion of the rotating section is submerged in a body of water;

a force applied by the water against the portion of the rotating section as a result of the ladder moving relative to the body of water causes the rotating section to apply a first force that is greater than and opposed to the spring force upon the gas spring to rotate the rotating section from the deployed position toward the stowed position; and the first force applied by the rotating section is reduced as a result of the force applied by the water against the portion of the rotating section, reducing said first force as the rotating section rotates from the deployed position toward the stowed position, wherein the first force is reduced until the first force is less than to the spring force and the gas spring rotating the rotating section into the stowed position; and the at least one gas spring defines a longitudinal axis that is angled toward the body of water such that gas opposes movement of the rotating section from the stowed position into the deployed position.

* * * * *